US008997402B2

(12) United States Patent
Mao

(10) Patent No.: US 8,997,402 B2
(45) Date of Patent: Apr. 7, 2015

(54) DOOR DEVICE CAPABLE OF SWITCHING STATUSES AND STORAGE EQUIPMENT USING THE SAME

(71) Applicant: Wistron Corp., New Taipei (TW)

(72) Inventor: Zhong-Hui Mao, New Taipei (TW)

(73) Assignee: Wistron Corp., New Taipei (TW)

( * ) Notice: Subject to any disclaimer, the term of this patent is extended or adjusted under 35 U.S.C. 154(b) by 0 days.

(21) Appl. No.: 14/093,525
(22) Filed: Dec. 2, 2013
(65) Prior Publication Data

US 2015/0061481 A1 Mar. 5, 2015

(30) Foreign Application Priority Data

Sep. 5, 2013 (CN) ..... 2013 1 0401171

(51) Int. Cl.
*E05F 1/10* (2006.01)
*A47B 95/00* (2006.01)
*A47B 96/00* (2006.01)
*E05D 7/12* (2006.01)

(52) U.S. Cl.
CPC . *E05F 1/10* (2013.01); *A47B 95/00* (2013.01); *A47B 96/00* (2013.01); *E05D 7/123* (2013.01); *E05D 2700/00* (2013.01)

(58) Field of Classification Search
CPC ..... E06B 3/82; E06B 3/822; E05Y 2900/202; E05Y 2900/302
USPC ..... 49/379, 226, 254, 257, 364, 394, 400, 49/149, 158, 176, 177, 208; 16/85, 82; 312/138.1, 319.2, 326, 329; 292/DIG. 4, DIG. 11, DIG. 17
See application file for complete search history.

(56) References Cited

U.S. PATENT DOCUMENTS

| | | | | |
|---|---|---|---|---|
| 1,149,652 | A * | 8/1915 | Kurz | 49/208 |
| 1,549,705 | A * | 8/1925 | Antonio | 217/60 R |
| 2,815,528 | A * | 12/1957 | Murray | 16/339 |
| 4,292,707 | A * | 10/1981 | Williams | 16/48.5 |
| 4,483,044 | A * | 11/1984 | Johnston et al. | 16/70 |
| 5,458,412 | A * | 10/1995 | Lee et al. | 312/309 |
| 5,657,743 | A * | 8/1997 | Schwarzbacker et al. | 126/194 |
| 5,904,411 | A * | 5/1999 | Hayakawa | 312/319.2 |
| 6,695,165 | B2 * | 2/2004 | Park | 220/812 |
| 6,825,413 | B2 | 11/2004 | Jeon et al. | |
| 6,845,545 | B2 * | 1/2005 | Han et al. | 16/277 |
| 8,047,198 | B2 * | 11/2011 | Meyer et al. | 126/190 |
| 8,287,061 | B2 * | 10/2012 | Ha | 312/405 |

* cited by examiner

*Primary Examiner* — Katherine Mitchell
*Assistant Examiner* — Marcus Menezes
(74) *Attorney, Agent, or Firm* — CKC & Partners Co., Ltd.

(57) ABSTRACT

The disclosure discloses a door device including a panel, a pivoting arm module, and a door. The pivoting arm module includes a holder and a panel-pivoting arm. The holder is located in a doorway of the panel and fixed to the panel. The holder has an entrance and an accommodating trough. The panel-pivoting arm is slidably accommodated in the accommodating trough and can present a received status or an ejected status relative to the holder. The door is pivotally connected to the panel-pivoting arm. When the panel-pivoting arm presents the received status, the door abuts against the panel and closes the doorway, and the appearance surface of the door is flush with that of the panel. When the panel-pivoting arm presents the ejected status, the door leaves the panel and can rotate relative to the panel-pivoting arm to open the doorway.

16 Claims, 13 Drawing Sheets

DOOR DEVICE CAPABLE OF SWITCHING STATUSES AND STORAGE EQUIPMENT USING THE SAME

This application claims priority to Chinese Application Serial Number 201310401171.0, filed Sep. 5, 2013, which is herein incorporated by reference.

BACKGROUND

1. Technical Field

The present disclosure relates to a door device and a storage equipment applying the door device.

2. Description of Related Art

For safety or aesthetics, electronic equipment generally needs a housing to protect or decorate stationary structures of internal components. To conveniently maintain and use the equipment for users, it is required a door to be opened for the housing.

Taking the example of a network storage equipment in which a plurality of hard disks are stored, the decorative panel of the network storage equipment must has a doorway and equipped with a door to be opened, so that users can conveniently replace the hard disks. In general, the door is positioned at the center of the decorative panel, and the gap at the junction between the door and the decorative panel must be small. However, even the small gap will inevitably cause structural interference between the door and the decorative panel, and thus the door cannot be rotated and opened.

Accordingly, how to provide an improved door device to solve the foregoing problem becomes an important issue to be solved.

SUMMARY

The disclosure provides a door device. The door device includes a panel, a pivoting arm module, and a door. The panel has a doorway. The pivoting arm module includes a holder and a panel-pivoting arm. The holder is located in the doorway and fixed to the panel. The holder has an entrance and an accommodating trough inwardly formed from the entrance. The panel-pivoting arm is slidably accommodated in the accommodating trough from the entrance, and is capable of presenting a received status or an ejected status relative to the holder. The door is pivotally connected to the panel-pivoting arm. When the panel-pivoting arm presents the received status relative to the holder, the door abuts against the panel and closes the doorway, and the appearance surface of the door is flush with the appearance surface of the panel. When the panel-pivoting arm presents the ejected status relative to the holder, the door leaves the panel and is capable of rotating relative to the panel-pivoting arm to open the doorway.

In an embodiment of the disclosure, the panel-pivoting arm has a first through hole. The pivoting arm module further includes a locking lever. The locking lever includes a linkage, a biasing block, and an engaging block. The biasing block is connected to an end of the linkage and engaged in the first through hole. The biasing block has an edge. The edge deviates from an axis of the linkage and abuts against an inner wall of the first through hole. The engaging block is connected to another end of the linkage and slidably engaged with the inner wall of the accommodating trough.

In an embodiment of the disclosure, the panel-pivoting arm further has a second through hole communicated with the first through hole. The pivoting arm module further includes a compression spring. The compression spring is accommodated in the second through hole and compressed between the bottom of the accommodating trough and the biasing block, so as to make the locking lever rotate relative to the panel-pivoting arm with the edge as a rotation center.

In an embodiment of the disclosure, the biasing block has a cambered surface. The edge is located at a distal end of the cambered surface. The compression spring is compressed between the bottom of the accommodating trough and the cambered surface.

In an embodiment of the disclosure, the holder has an annular groove located in the accommodating trough. The engaging block is slidably engaged in the annular groove.

In an embodiment of the disclosure, an inner wall surface of the annular groove has a first concave vertex adjacent to the bottom of the accommodating trough. An outer wall surface of the annular groove has a second concave vertex adjacent to the entrance. When the panel-pivoting arm presents the received status relative to the holder, the engaging block is engaged at the first concave vertex. When the panel-pivoting arm presents the ejected status relative to the holder, the engaging block is engaged at the second concave vertex.

In an embodiment of the disclosure, the panel-pivoting arm is slidably accommodated in the accommodating trough along a sliding direction. The annular groove has a first path and a second path. The first path and the second path are communicated end to end between the first concave vertex and the second concave vertex. During the period that the panel-pivoting arm switches from the received status to the ejected status relative to the holder, the panel-pivoting arm slides toward the bottom of the holder along the sliding direction to make the engaging block leave the first concave vertex, the compression spring then pushes the biasing block to make the panel-pivoting arm slide toward the entrance along the sliding direction and make the locking lever rotate relative to the panel-pivoting arm, so as to make the engaging block slide to the second concave vertex from the first concave vertex along the first path.

In an embodiment of the disclosure, the inner wall surface of the annular groove further has a convex vertex adjacent to the second concave vertex. The convex vertex deviates toward the first path in a horizontal direction perpendicular to the sliding direction. The second concave vertex deviates toward the second path in the horizontal direction. During the period that the panel-pivoting arm switches from the ejected status to the received status relative to the holder, the panel-pivoting arm slides toward the holder along the sliding direction, so as to make the engaging block leave the second concave vertex and slide to the first concave vertex along the second path.

In an embodiment of the disclosure, the holder further has an assembling groove. The assembling groove is located in the accommodating trough and communicated with the entrance and the first path. The engaging block is engaged in the annular groove from the entrance via the assembling groove.

In an embodiment of the disclosure, the panel-pivoting arm further has a shaft hole and includes a cantilever. A distal end of the cantilever extends into an extending surface of an inner wall of the shaft hole. The door includes a door-pivoting arm. The door-pivoting arm is pivotally connected to the shaft hole and has at least one indentation. The indentation is configured to engage with the distal end of the cantilever, so as to fix a rotation angle with which the door is rotated relative to the panel-pivoting arm.

The disclosure further provides a storage equipment. The storage equipment includes a housing and a door device. The housing has an assembling opening and an accommodating space inwardly formed from the assembling opening. The door device includes a panel, a pivoting arm module, and a door. The panel is fixed to the housing and covers the assembling opening. The panel has a doorway. The pivoting arm module includes a holder and a panel-pivoting arm. The holder is located in the doorway and fixed to the panel. The holder has an entrance and an accommodating trough inwardly formed from the entrance. The panel-pivoting arm is slidably accommodated in the accommodating trough from the entrance, and is capable of presenting a received status or an ejected status relative to the holder. The door is pivotally connected to the panel-pivoting arm. When the panel-pivoting arm presents the received status relative to the holder, the door abuts against the panel and closes the doorway, and the appearance surface of the door is flush with the appearance surface of the panel. When the panel-pivoting arm presents the ejected status relative to the holder, the door leaves the panel and is capable of rotating relative to the panel-pivoting arm to open the doorway.

Accordingly, by pressing the door of the door device of the disclosure, the door can selectively close the doorway of the panel, or leave the panel and rotate to open the doorway. When the door closes the doorway of the panel, the appearance surface of the door is flush with the appearance surface of the panel, and a small gap is formed at the junction between the door and the panel, so that the appearance of the door device looks good and can prevent the door from rotating relative to the panel unexpectedly. After the closed door is pressed toward the panel, the door translationally ejects out from the panel for a predetermined stroke, and is capable of rotating relative to the panel to open the doorway without causing structural interference. Therefore, electronic components installed in the housing of the storage equipment can be maintained or replaced.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1A:
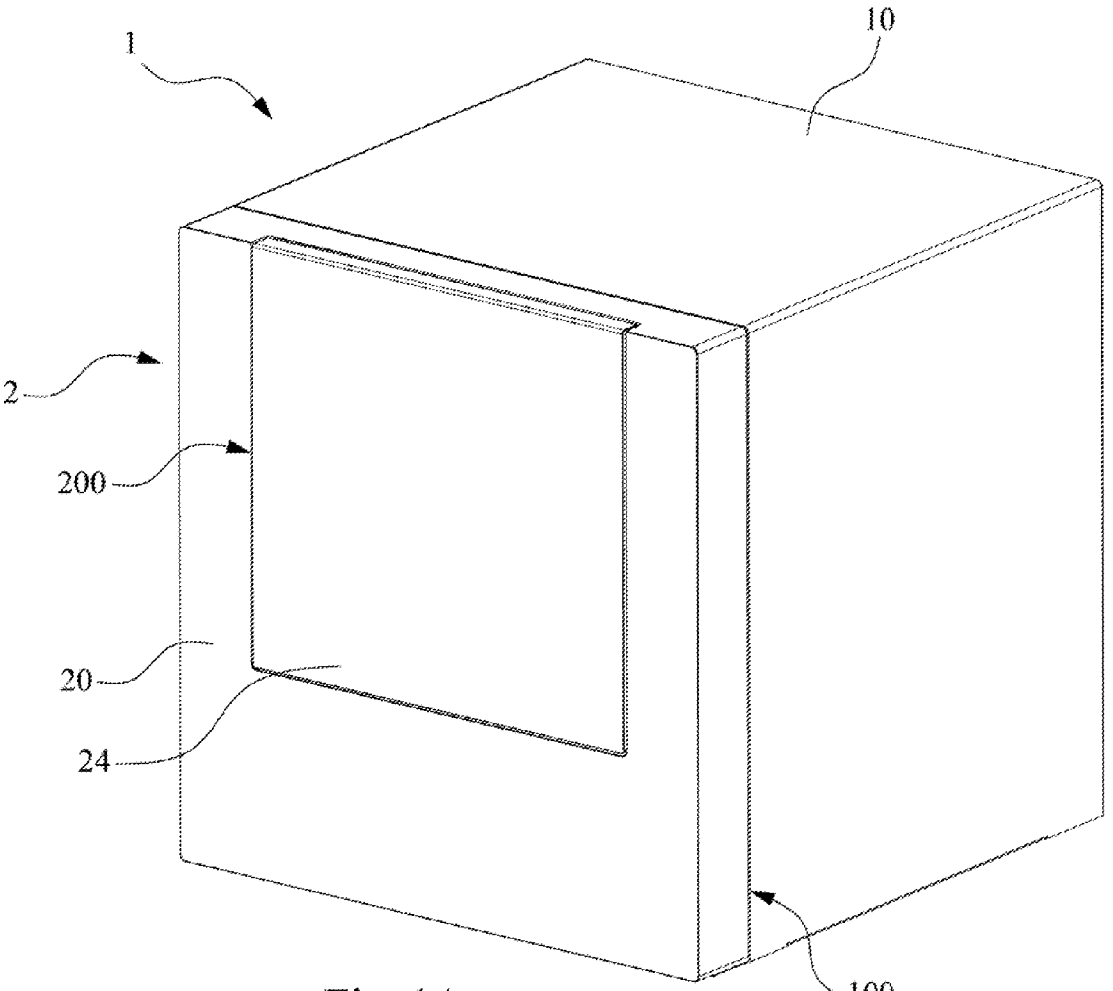
FIG. 1A is a perspective view of a storage equipment according to an embodiment of this disclosure, in which a door closes a doorway.

Reference will now be made in detail to the present embodiments of the disclosure, examples of which are illustrated in the accompanying drawings. Wherever possible, the same reference numbers are used in the drawings and the description to refer to the same or like parts.

Figure 1B:
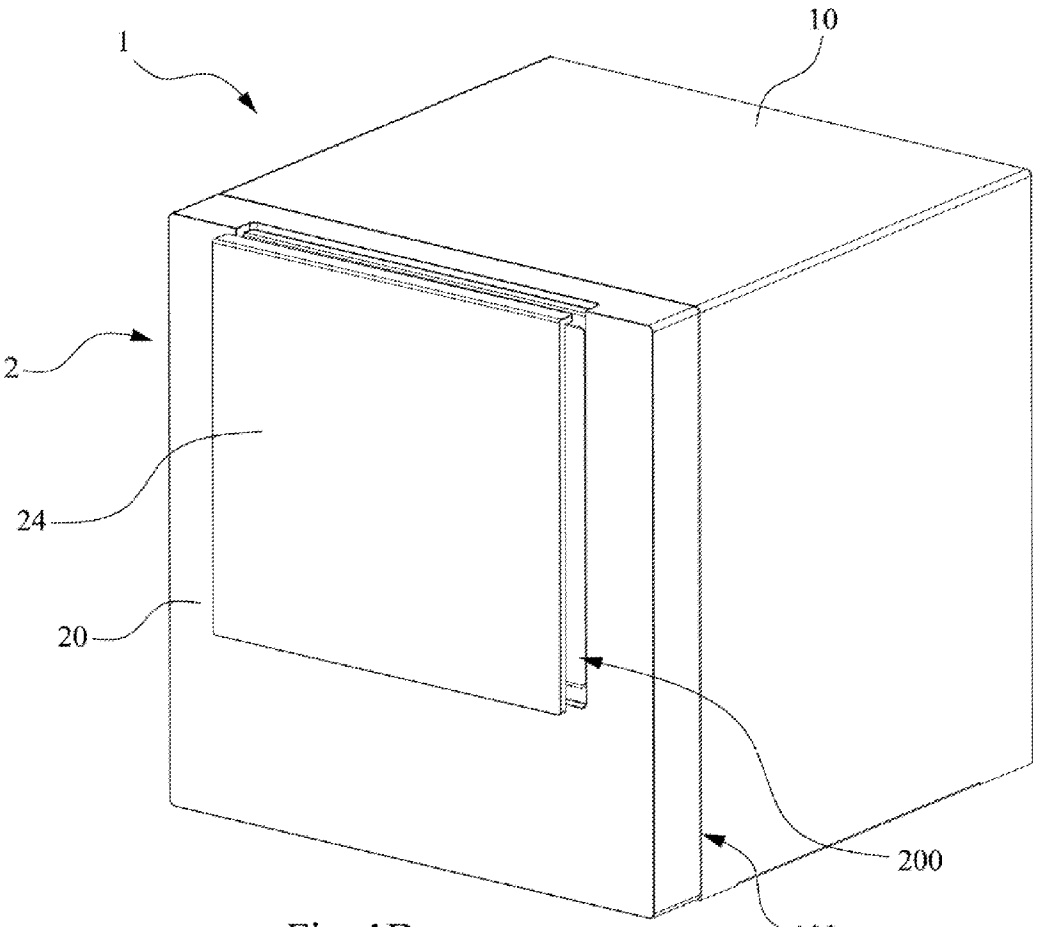
FIG. 1B is another perspective view of the storage equipment in FIG. 1A, in which the door translationally ejects out from a panel for a predetermined stroke.
Figure 1C:
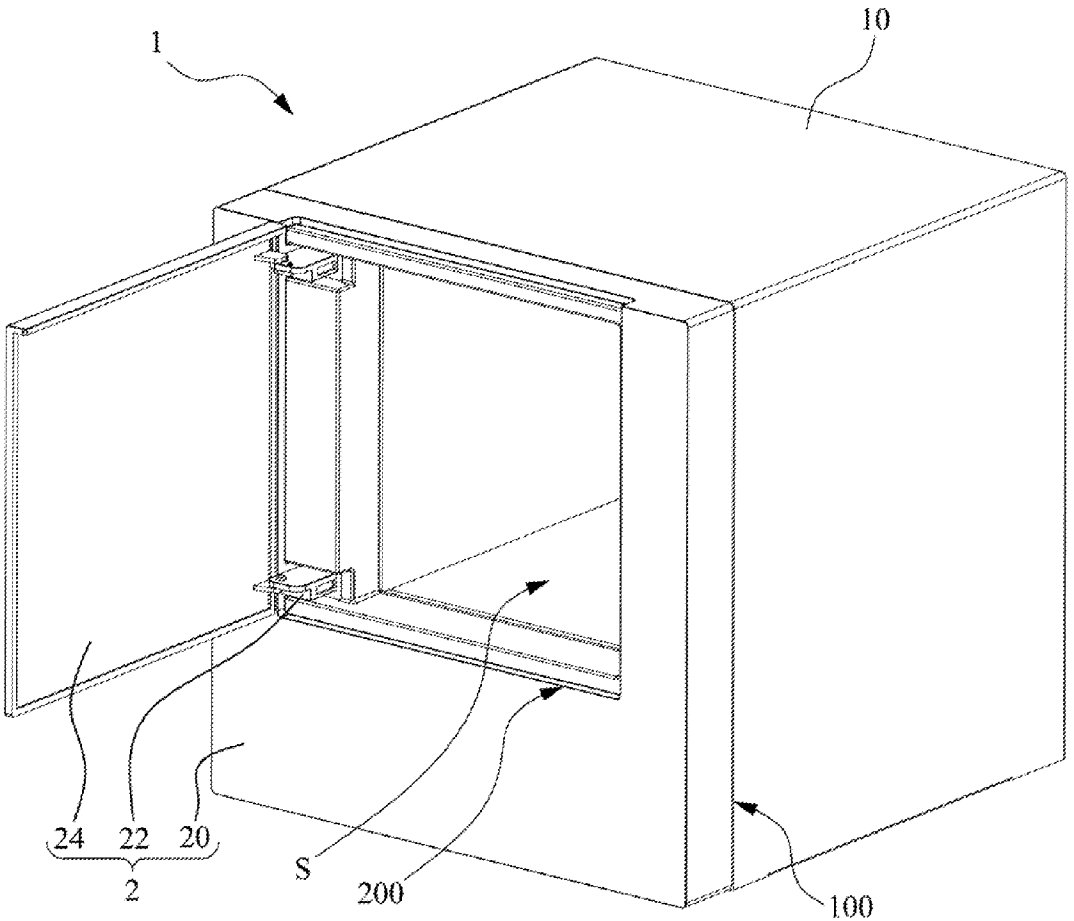
FIG. 1C is another perspective view of the storage equipment in FIG. 1A, in which the door rotates relative to the panel to open the doorway.

FIG. 1A is a perspective view of a storage equipment 1 according to an embodiment of this disclosure, in which a door 24 closes a doorway 200. FIG. 1B is another perspective view of the storage equipment 1 in FIG. 1A, in which the door 24 translationally ejects out from a panel 20 for a predetermined stroke. FIG. 1C is another perspective view of the storage equipment 1 in FIG. 1A, in which the door 24 rotates relative to the panel 20 to open the doorway 200.

As shown in FIG. 1A to FIG. 1C, the storage equipment 1 includes a housing 10 and a door device 2. One side of the housing 10 has an assembling opening 100, and an accommodating space S is inwardly formed from the assembling opening 100. The accommodating space S of the housing 10 can be used to accommodate electronic components (not shown). The door device 2 includes the panel 20, a pivoting arm module 22, and the door 24. The panel 20 is fixed to the housing 10 and covers the assembling opening 100. The panel 20 has a doorway 200. The door 24 is capable of abutting against the panel 20 and closing the doorway 200.

Figure 2:
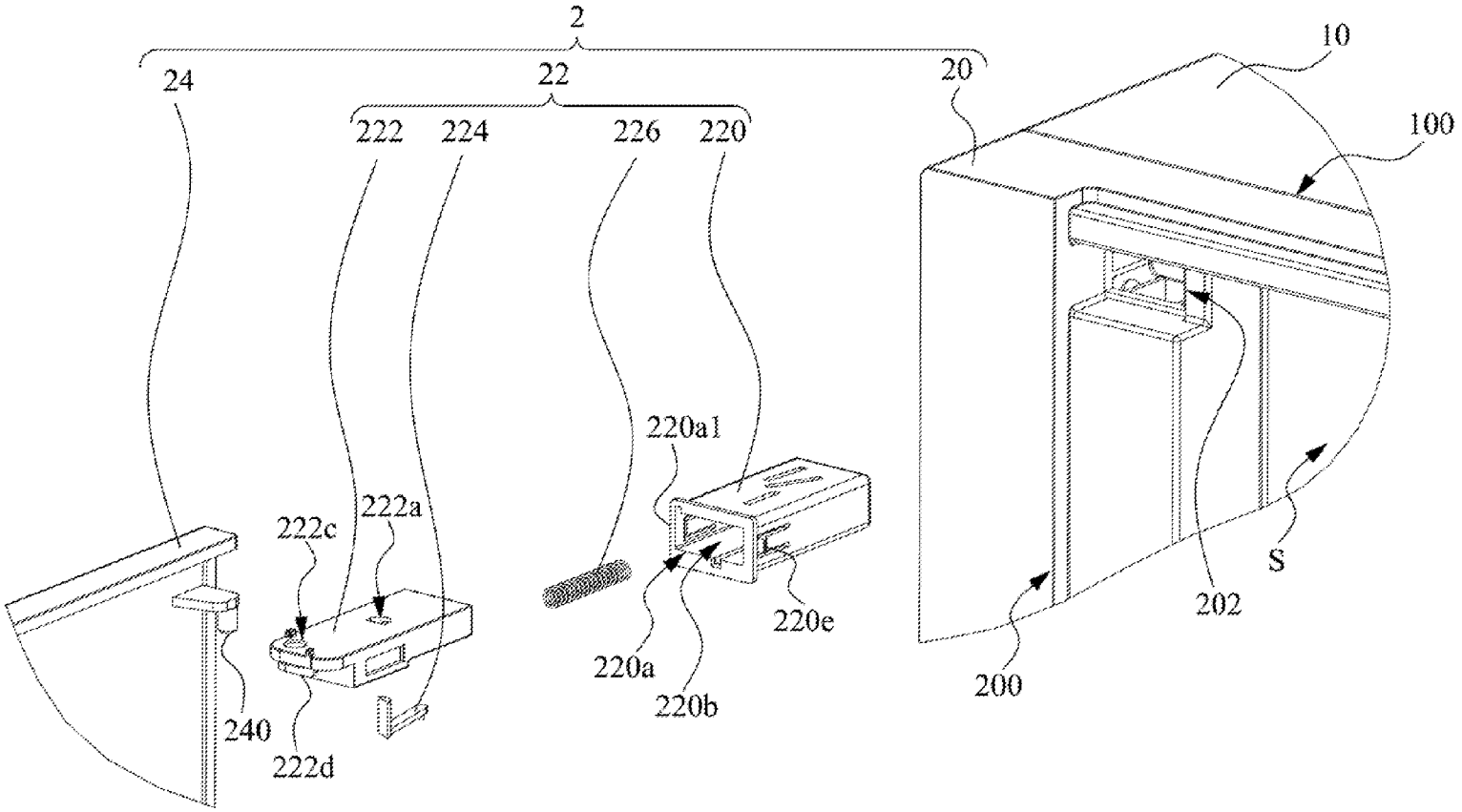
FIG. 2 is a partial exploded view of the storage equipment in FIG. 1C.

FIG. 2 is a partial exploded view of the storage equipment 1 in FIG. 1C.

As shown in FIG. 1C and FIG. 2, the pivoting arm module 22 includes a holder 220 and a panel-pivoting arm 222. The assembled holder 220 is located in the doorway 200 of the panel 20, and is fixed to the panel 20. The holder 220 has an entrance 220*a* and an accommodating trough 220*b* inwardly formed from the entrance 220*a*. The panel-pivoting arm 222 is slidably accommodated in the accommodating trough 220*b* of the holder 220 from the entrance 220*a*, and is capable of presenting a received status or an ejected status relative to the holder 220. The door 24 is pivotally connected to the panel-pivoting arm 222. When the panel-pivoting arm 222 presents the received status relative to the holder 220, the door 24 abuts against the panel 20 and closes the doorway 200, and the appearance surface of the door 24 is flush with the appearance surface of the panel 20 (as shown in FIG. 1A). When the panel-pivoting arm 222 presents the ejected status relative to the holder 220, the door 24 leaves the panel 20 (as shown in FIG. 1B). The door 24 that leaves the panel 20 is capable of rotating relative to the panel-pivoting arm 222 to open the doorway 200 (as shown in FIG. 1C).

Figure 3A:
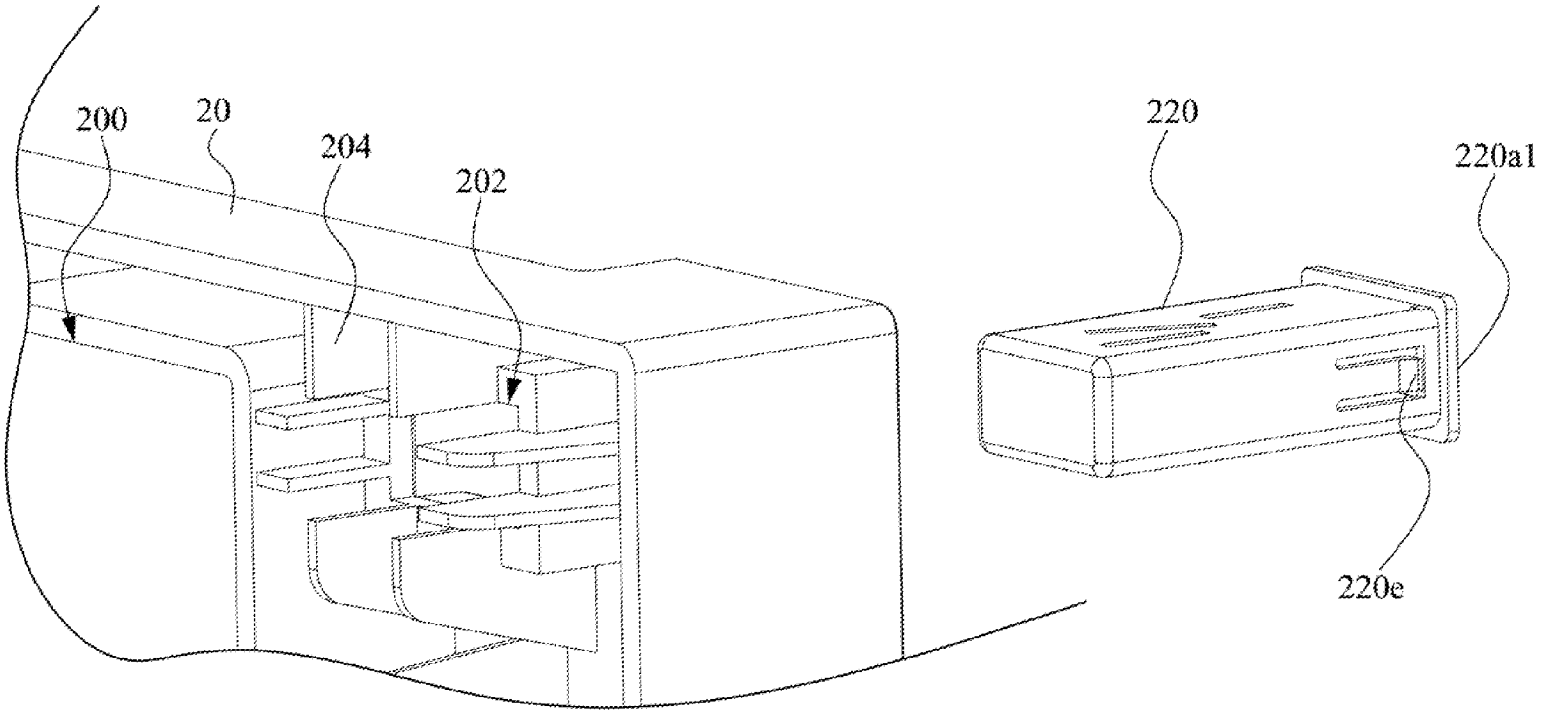
FIG. 3A is an exploded view of the panel and a holder.
Figure 3B:
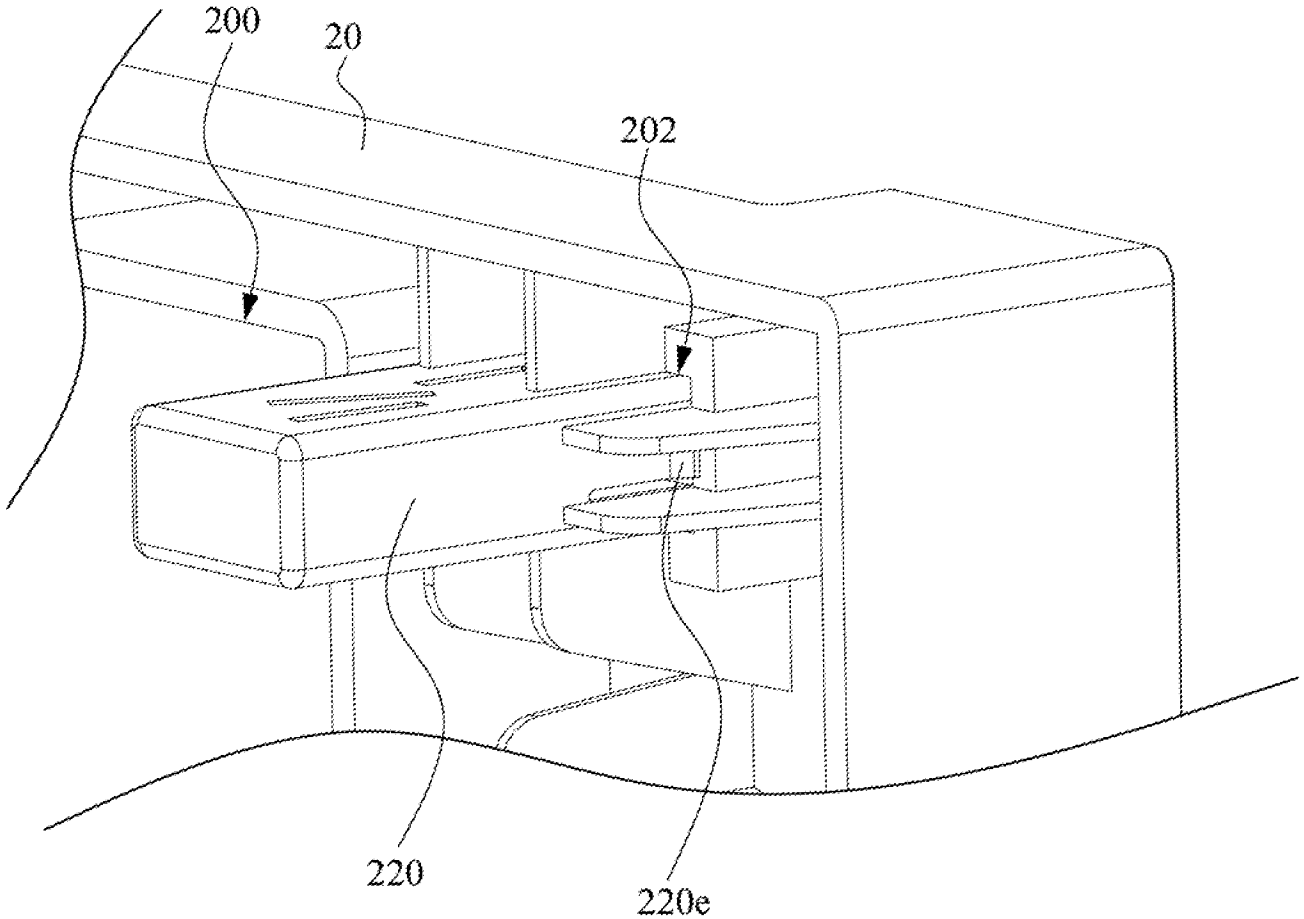
FIG. 3B is an assembly view of the panel and the holder in FIG. 3A.

FIG. 3A is an exploded view of the panel 20 and the holder 220. FIG. 3B is an assembly view of the panel 20 and the holder 220 in FIG. 3A.

As shown in FIG. 2 to FIG. 3B, the panel 20 further has a mounting hole 202 located in the doorway 200. The panel 20 includes a plurality of supporting ribs 204 located at the rear side (i.e., the side with which the panel 20 is assembled to the assembling opening 100) of the panel 20. The supporting ribs 204 radially connect and surround the mounting hole 202. The holder 220 further includes a flange 220*a*1 and hooks 220*e*. The flange 220*a*1 is extended outwardly from the entrance 220*a* of the holder 220. The hooks 220*e* are formed at the outer surface of the holder 220 by puncture forming. The mounting hole 202 of the panel 20 and the outer surface of the holder 220 form a sliding fit. At least a size of the mounting hole 202 is smaller than a size of the flange 220*a*1 of the holder 220 in a dimension, so the mounting hole 202 does not allow the flange 220*a*1 to pass through. During the period that the holder 220 passes into the mounting hole 202, the mounting hole 202 and the supporting ribs 204 of the panel 20 guide and support the outer surface of the holder 220, so as to prevent the holder 220 from shaking relative to the panel 20. During the period that the hooks 220*e* of the holder 220 pass through the mounting hole 202, the hooks 220*e* will be pressed into the accommodating trough 220*b* by the inner wall of the mounting hole 202, so the holder 220 can continuously pass through the mounting hole 202. When the flange 220*a*1 of the holder 220 abuts against the front side (i.e., the side with which the panel 20 faces the door 24) of the panel 20, the hooks 220*e* have completely passed through the mounting hole 202 and recovered. Hence, the flange 220*a*1 and the hooks 220*e* can respectively abut against the front side and the rear side of the panel 20 to clamp the panel 20, and thus the holder 220 is fixed to the panel 20.

Figure 5:
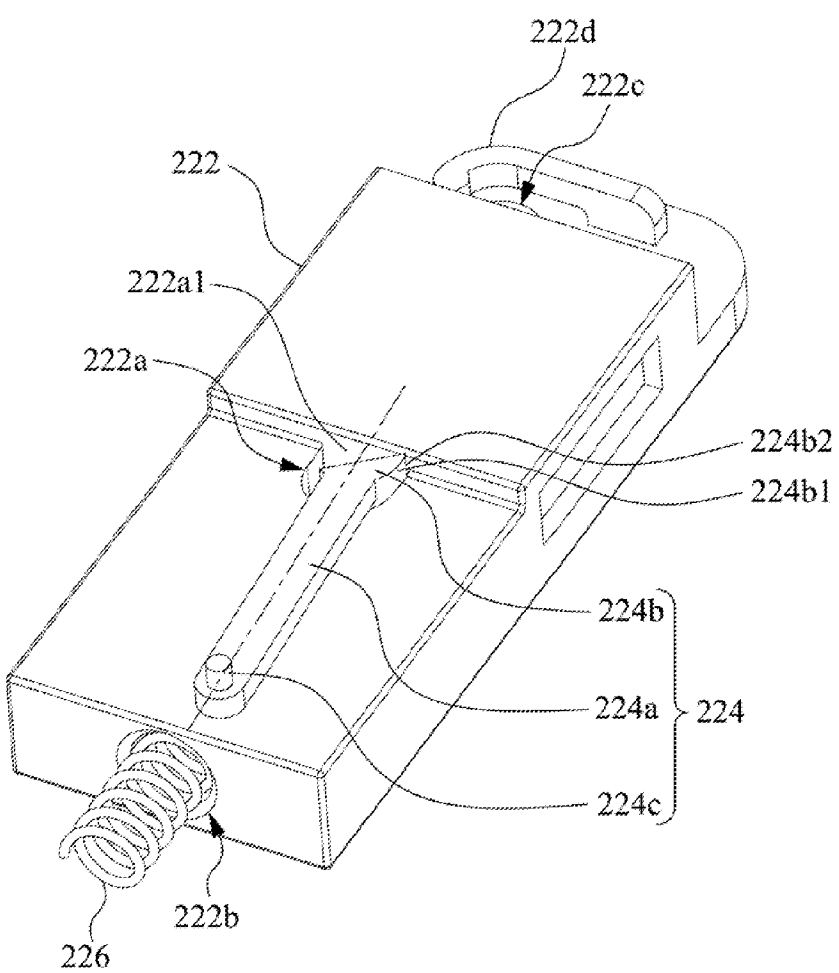
FIG. 5 is an assembly view of a panel-pivoting arm, the locking lever, and a compression spring.
Figure 4:
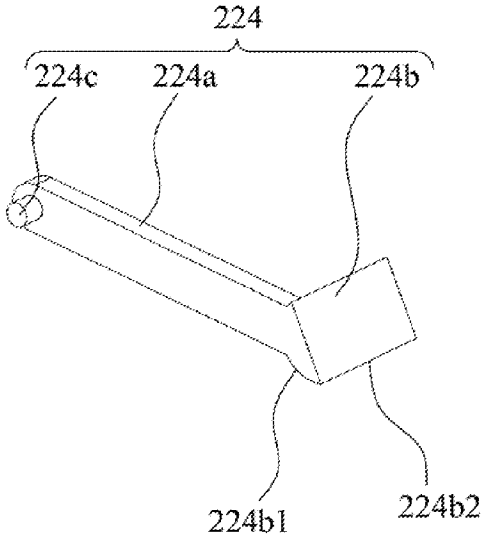
FIG. 4 is a perspective view of a locking lever.

FIG. 4 is a perspective view of a locking lever 224. FIG. 5 is an assembly view of the panel-pivoting arm 222, the locking lever 224, and a compression spring 226.

As shown in FIG. 4 and FIG. 5 with reference to FIG. 2, the panel-pivoting arm 222 has a first through hole 222*a*. The panel-pivoting arm 222 has a flat wall 222*a*1 in the first through hole 222*a*. The pivoting arm module 22 further includes the locking lever 224. The locking lever 224 includes a linkage 224*a*, a biasing block 224*b*, and an engaging block 224*c*. The biasing block 224*b* is connected to an end of the linkage 224*a* and engaged in the first through hole 222*a* of the panel-pivoting arm 222. The biasing block 224*b* has a cambered surface 224*b*1 an edge 224*b*2. The edge 224*b*2 is located at a distal end of the cambered surface 224*b*1 (i.e., the edge 224*b*2 is located at the end of the cambered surface 224*b*1 that away from the linkage 224*a*). The edge 224*b*2 deviates from an axis of the linkage 224*a* (as indicated by the dotted line in FIG. 5), and abuts against an inner wall of the first through hole 222*a* (in detail, the edge 224*b*2 abuts against the flat wall 222*a*1). The engaging block 224*c* is connected to another end of the linkage 224*a* and slidably engaged with the inner wall of the accommodating trough 220*b* of the holder 220, so as to mount the panel-pivoting arm 222 to the holder 220. In addition, the panel-pivoting arm 222 further has a second through hole 222*b*. The second through hole 222*b* is communicated with the first through hole 222*a*. The pivoting arm module 22 further includes the compression spring 226. The compression spring 226 is accommodated in the second through hole 222*b*.

In the embodiment of the disclosure, the biasing block 224*b* of the locking lever 224 is semi-cylinder shaped, and the engaging block 224*c* is cylinder shaped, but the disclosure is not limited in this regard.

Figure 6:
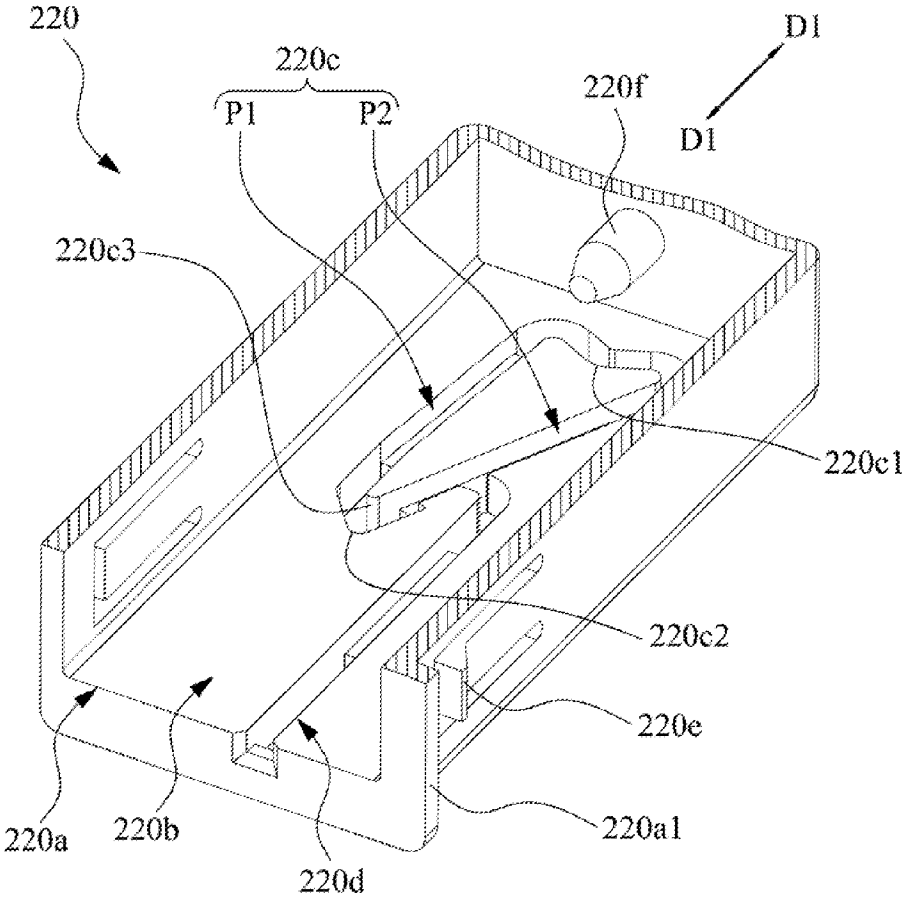
FIG. 6 is a perspective sectional view of the holder.

FIG. 6 is a perspective sectional view of the holder 220.

As shown in FIG. 5 and FIG. 6, when the panel-pivoting arm 222 is slidably accommodated in the accommodating trough 220*b* of the holder 220, the compression spring 226 is compressed between the bottom of the accommodating trough 220*b* and the cambered surface 224*b*1 of the biasing block 224*b*, so as to make the locking lever 224 rotate relative to the panel-pivoting arm 222 with the edge 224*b*2 as a rotation center. In other words, the compressed compressing spring 226 will bias the cambered surface 224*b*1 of the biasing block 224*b*, so as to make the locking lever 224 in FIG. 5 rotate clockwise. In the embodiment of the disclosure, the cambered surface 224*b*1 of the biasing block 224*b* can be smoothly forced by the compressing spring 226, so that abrasions between the locking lever 224 and the compression spring 226 can be eased, but the disclosure is not limited in this regard.

In addition, the holder 220 further includes a positioning column 220*f* located at the bottom of the accommodating trough 220*b*. The positioning column 220*f* is sleeved by the compression spring 226, so as to retain the compression spring 226.

As shown in FIG. 6, the holder 220 has an annular groove 220*c* and an assembling groove 220*d*. The annular groove 220*c* and the assembling groove 220*d* are located in the accommodating trough 220*b*. The assembling groove 220*d* is communicated with the entrance 220*a* and the annular groove 220*c*. Therefore, the engaging block 224*c* of the locking lever 224 can enter the annular groove 220*c* from the entrance 220*a* of the holder 220 via the assembling groove 220*d*, and thus be slidably engaged in the annular groove 220*c*. In the embodiment of the disclosure, the assembling groove 220*d* is L-shaped, but the disclosure is not limited in this regard.

Figure 7A:
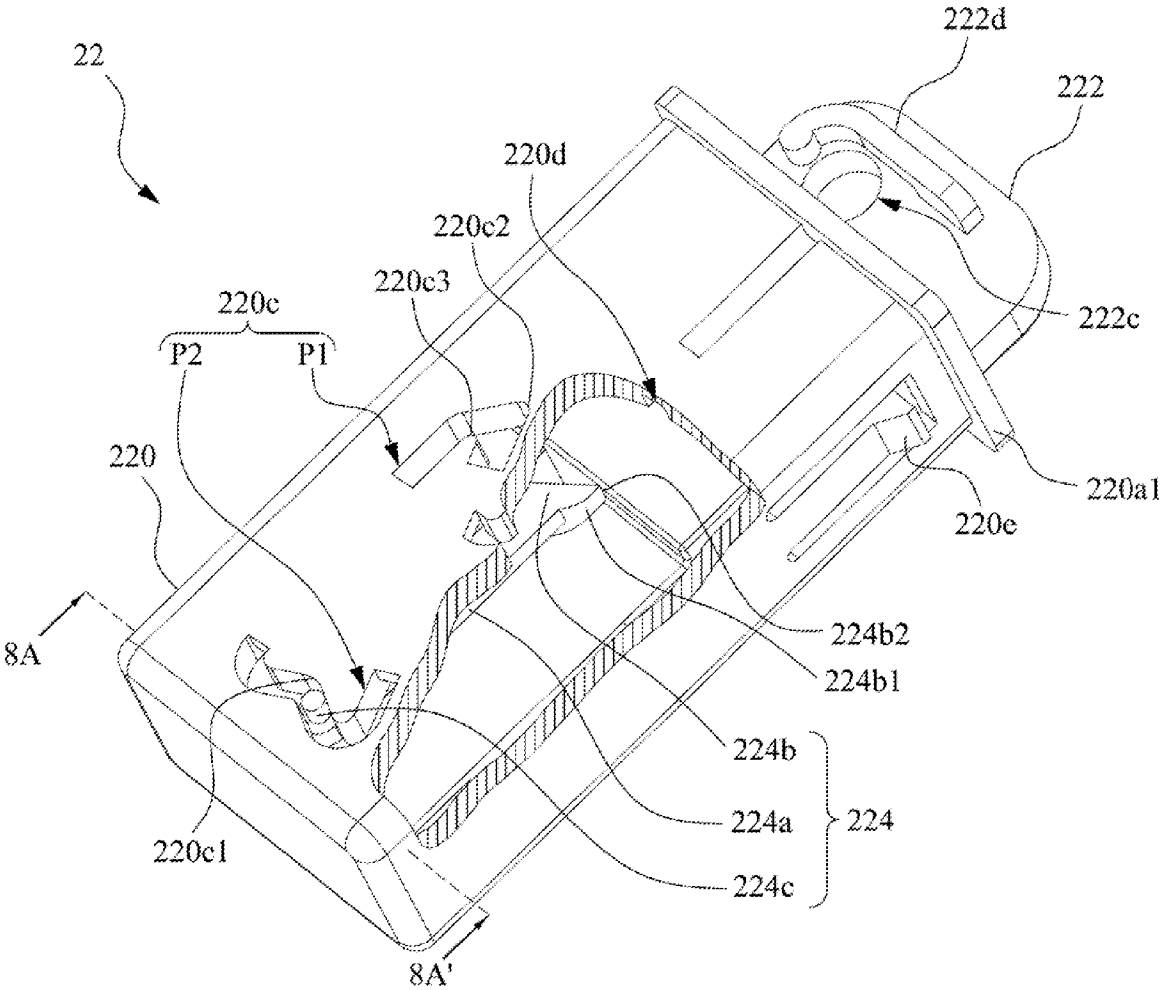
FIG. 7A is a perspective sectional view of a pivoting arm module, in which the panel-pivoting arm presents a received status relative to the holder.
Figure 7B:
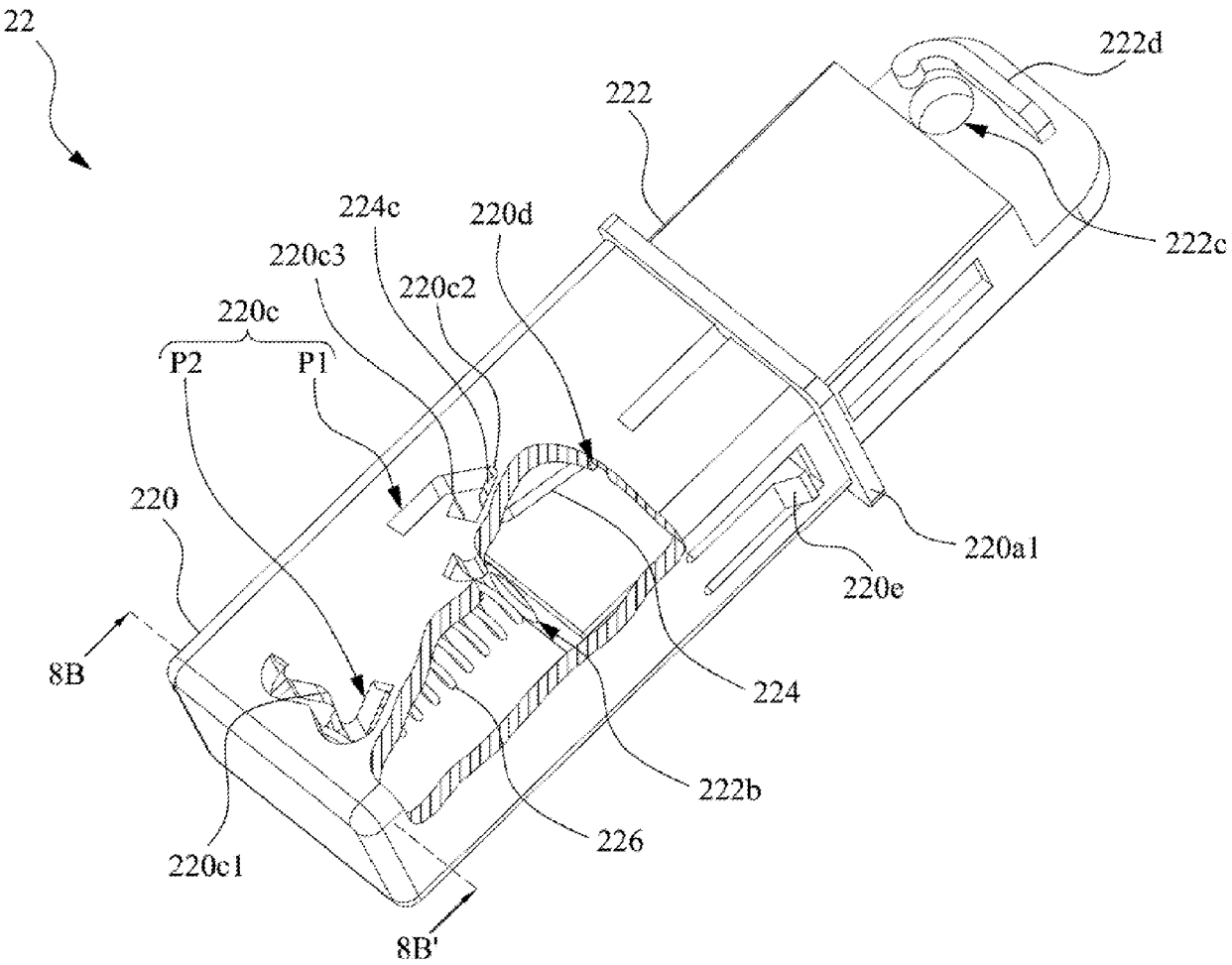
FIG. 7B is another perspective sectional view of the pivoting arm module, in which the panel-pivoting arm presents an ejected status relative to the holder.
Figure 8A:
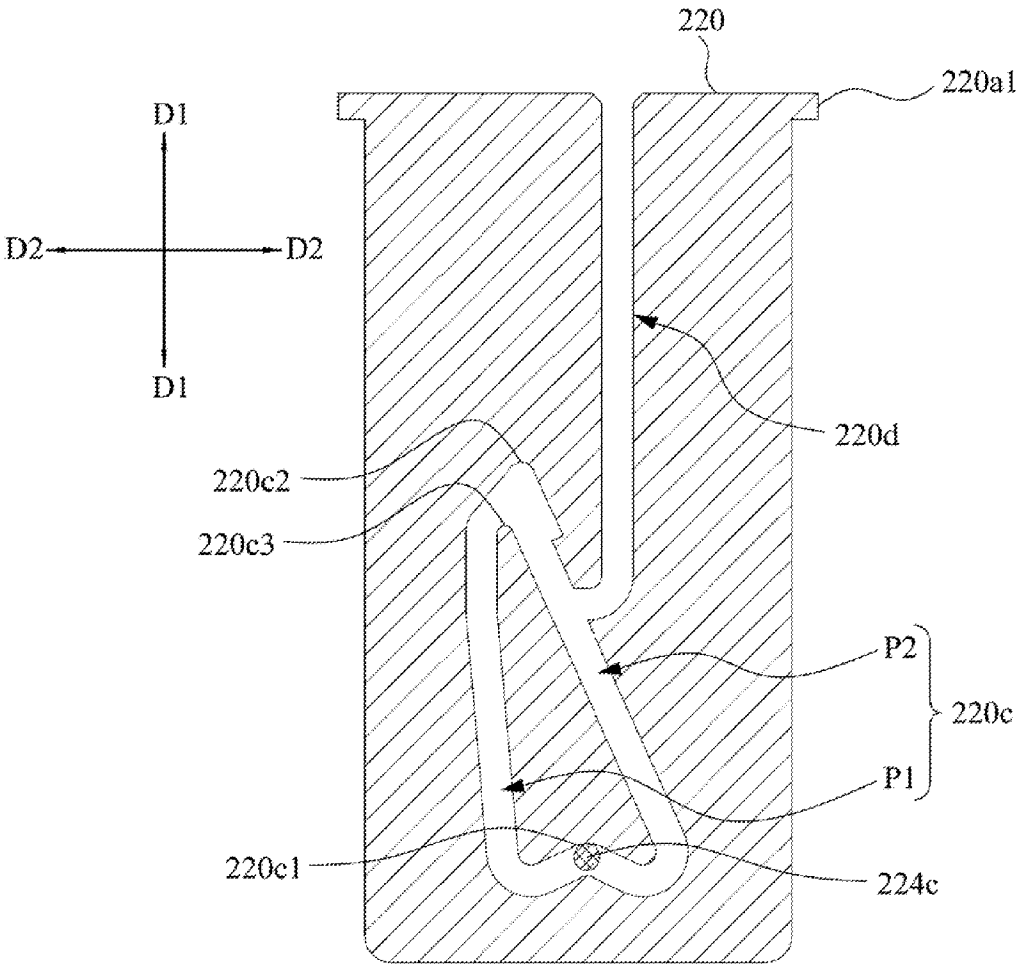
FIG. 8A is a sectional view of FIG. 7A along line 8A-8A'.
Figure 8B:
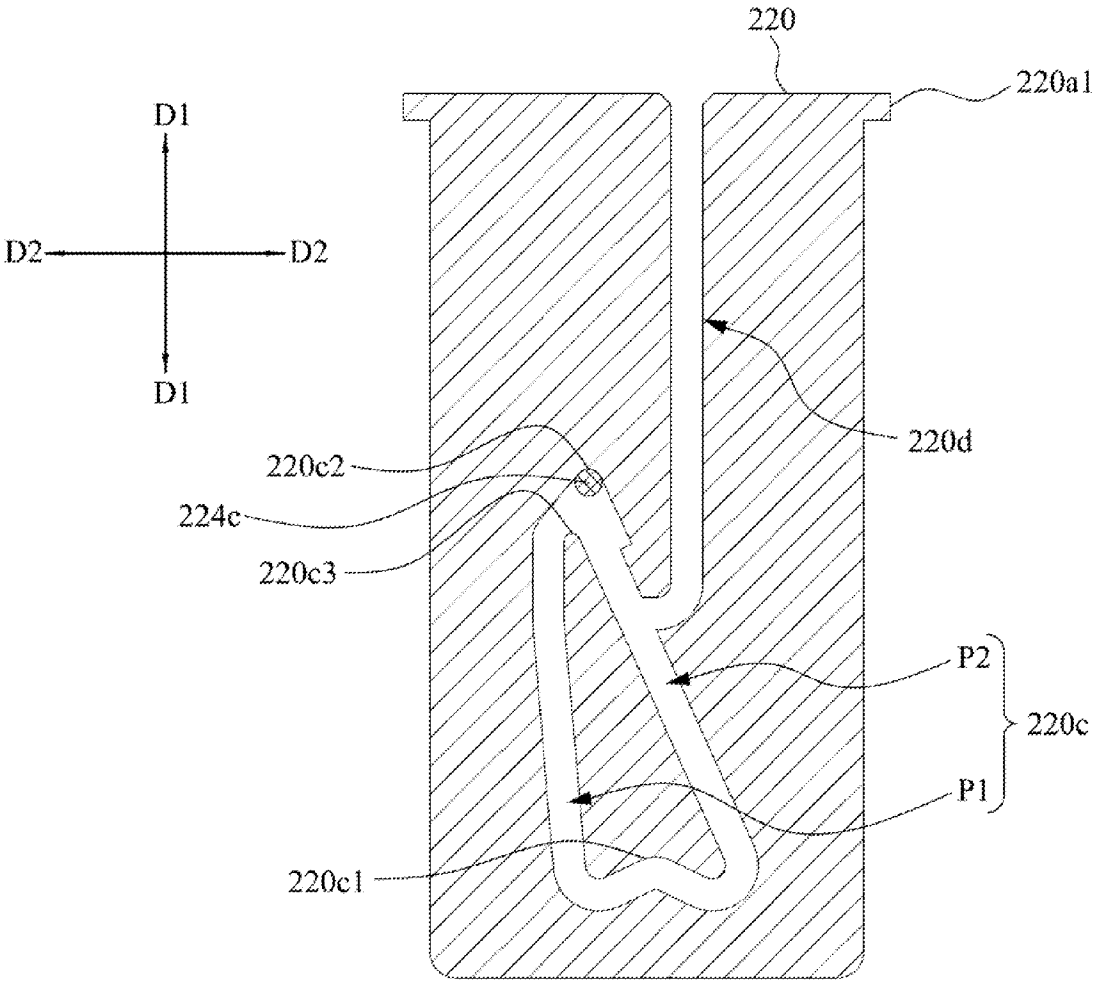
FIG. 8B is a sectional view of FIG. 7B along line 8B-8B'.

FIG. 7A is a perspective sectional view of the pivoting arm module 22, in which the panel-pivoting arm 222 presents a received status relative to the holder 220. FIG. 7B is another perspective sectional view of the pivoting arm module 22, in which the panel-pivoting arm 222 presents an ejected status relative to the holder 220. FIG. 8A is a sectional view of FIG. 7A along line 8A-8A'. FIG. 8B is a sectional view of FIG. 7B along line 8B-8B'.

As shown in FIG. 7A and FIG. 8A with reference to FIG. 6, the holder 220 and the panel-pivoting arm 222 form a sliding fit, so that the panel-pivoting arm 222 can be slidably accommodated in the accommodating trough 220*b* along a sliding direction D1. An inner wall surface of the annular groove 220*c* has a first concave vertex 220*c*1. The first concave vertex 220*c*1 is adjacent to the bottom of the accommodating trough 220*b*. An outer wall surface of the annular groove 220*c* has a second concave vertex 220*c*2. The second concave vertex 220*c*2 is adjacent to the entrance 220*a* of the holder 220. The annular groove 220*c* has a first path P1 and a second path P2. The first path P1 and the second path P2 are communicated end to end between the first concave vertex 220*c*1 and the second concave vertex 220*c*2. When the panel-pivoting arm 222 presents the received status relative to the holder 220 (as shown in FIG. 7A), the engaging block 224*c* of the locking lever 224 is engaged at the first concave vertex 220*c*1. Meanwhile, the door 24 abuts against the panel 20 and closes the doorway 200, as shown in FIG. 1A.

As shown in FIG. 7B and FIG. 8B with reference to FIG. 6, when the panel-pivoting arm 222 presents the ejected status relative to the holder 220 (as shown in FIG. 7B), the engaging block 224*c* of the locking lever 224 is engaged at the second concave vertex 220*c*2 of the annular groove 220*c*. During the period that the panel-pivoting arm 222 switches from the received status to the ejected status relative to the holder 220, the panel-pivoting arm 222 slides toward the bottom of the holder 220 along the sliding direction D1 to make the engaging block 224*c* of the locking lever 224 leave the first concave vertex 220*c*1 (by pressing the door 24 toward the panel 20 for a little distance), the compression spring 226 then pushes the biasing block 224*b* to make the panel-pivoting arm 222 slide toward the entrance 220*a* of the holder 220 along the sliding direction D1 and make the locking lever 224 rotate relative to the panel-pivoting arm 222 (because the edge 224*b*2 deviates from the axis of the linkage 224*a*), so as to make the engaging block 224*c* of the locking lever 224 slide to the second concave vertex 220*c*2 from the first concave vertex 220*c*1 along the first path P1. Meanwhile, the door 24 leaves the panel 20 as shown in FIG. 1B, and then the door 24 can further rotate relative to the panel 20 as shown in FIG. 1C.

In addition, the inner wall surface of the annular groove 220*c* further has a convex vertex 220*c*3. The convex vertex 220*c*3 is adjacent to the second concave vertex 220*c*2. The convex vertex 220*c*3 deviates toward the first path P1 in a horizontal direction D2 perpendicular to the sliding direction D1 (i.e., the convex vertex 220*c*3 is more closer to the first path P1 than the second concave vertex 220*c*2 in the horizontal direction D2). The second concave vertex 220*c*2 deviates toward the second path P2 in the horizontal direction D2 (i.e., the second concave vertex 220*c*2 is more closer to the second path P2 than the convex vertex 220*c*3 in the horizontal direction D2). Therefore, during the period that the panel-pivoting arm 222 switches from the ejected status (as shown in FIG. 7B) to the received status (as shown in FIG. 7A) relative to the holder 220, the panel-pivoting arm 222 slides toward the bottom of the holder 220 along the sliding direction D1, so as to make the engaging block 224*c* of the locking lever 224 leave the second concave vertex 220*c*2 and slide to the first concave vertex 220*c*1 along the second path P2 (because the second concave vertex 220*c*2 deviates toward the second path P2, the engaging block 224*c* engaged at the second concave vertex 220*c*2 is much easier to enter the second path P2).

In the embodiment of the disclosure, the annular groove 220*c* is substantially heart shaped, but the disclosure is not limited in this regard.

Figure 10:
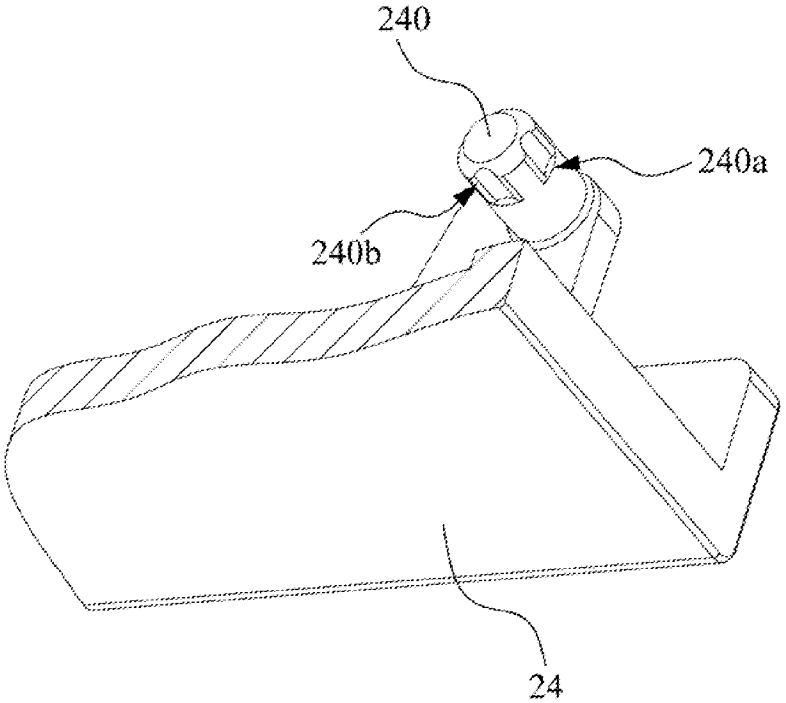
FIG. 10 is a partial sectional view of the door.
Figure 9:
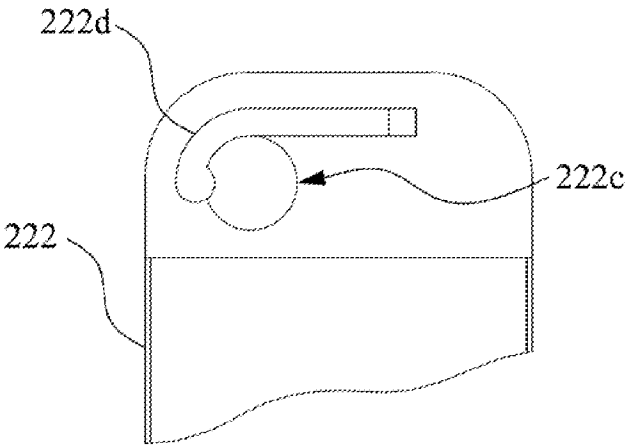
FIG. 9 is a partial top view of the panel-pivoting arm.

FIG. 9 is a partial top view of the panel-pivoting arm 222. FIG. 10 is a partial sectional view of the door 24.

As shown in FIG. 9 and FIG. 10 with reference to FIG. 2, the panel-pivoting arm 222 further has a shaft hole 222*c* and includes a cantilever 222*d*. During the period that the panel-pivoting arm 222 switches between the received status and the ejected status relative to the holder 220, the shaft hole 222*c* and the cantilever 222*d* are always located out of the holder 220. A distal end of the cantilever 222*d* extends into an extending surface of an inner wall of the shaft hole 222*c*. The door 24 includes a door-pivoting arm 240. The door-pivoting arm 240 is pivotally connected to the shaft hole 222*c*, and has a first indentation 240*a* and a second indentation 240*b*. The distal end of the cantilever 222*d* can be selectively engaged with the first indentation 240*a* or the second indentation 240*b*, so as to respectively fix rotation angles with which the door 24 is rotated relative to the panel-pivoting arm 222. For example, when the distal end of the cantilever 222*d* is engaged with the first indentation 240*a*, the appearance surface of the door 24 is parallel to the appearance surface of the panel 20 (as shown in FIG. 1A and FIG. 1B); when the distal end of the cantilever 222*d* is engaged with the second indentation 240*b*, the door 24 rotates 90 degrees relative to the panel 20 to open the doorway 200. However, the number of indentations included by the door-pivoting arm 240 and the rotation angles with which the indentations retain the door 24 to rotate relative to the panel 20 can be adjusted as needed and do not limited by the embodiment.

According to the foregoing recitations of the embodiments of the disclosure, it can be seen that by pressing the door of the door device of the disclosure, the door can selectively close the doorway of the panel, or leave the panel and rotate to open the doorway. When the door closes the doorway of the panel, the appearance surface of the door is flush with the appearance surface of the panel, and a small gap is formed at the junction between the door and the panel, so that the appearance of the door device looks good and can prevent the door from rotating relative to the panel unexpectedly. After the closed door is pressed toward the panel, the door translationally ejects out from the panel for a predetermined stroke, and is capable of rotating relative to the panel to open the doorway without causing structural interference. Therefore, electronic components installed in the housing of the storage equipment can be maintained or replaced.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A door device, comprising:

a panel having a doorway;

a pivoting arm module comprising a holder and a panel-pivoting arm, the holder located in the doorway and fixed to the panel, the holder having an entrance and an accommodating trough inwardly formed from the entrance, wherein the panel-pivoting arm is slidably accommodated in the accommodating trough from the entrance, and is capable of switching to a received status or an ejected status relative to the holder; and a door pivotally connected to the panel-pivoting arm, wherein when the panel-pivoting arm switches to the received status relative to the holder, the door abuts against the panel and closes the doorway, and an appearance surface of the door is flush with an appearance surface of the panel, and when the panel-pivoting arm switches to the ejected status relative to the holder, the door leaves the panel and is capable of rotating relative to the panel-pivoting arm to open the doorway, wherein the panel-pivoting arm has a first through hole, the pivoting arm module further comprises a locking lever, and the locking lever comprises:

a linkage;

a biasing block connected to an end of the linkage and engaged in the first through hole, wherein the biasing block has an edge, and the edge deviates from an axis of the linkage and abuts against an inner wall of the first through hole; and an engaging block connected to another end of the linkage and slidably engaged with an inner wall of the accommodating trough, and wherein the panel-pivoting arm further has a second through hole in spatial communication with the first through hole, the pivoting arm module further comprises a compression spring, the compression spring is accommodated in the second through hole and compressed between a bottom of the accommodating trough and the biasing block, so as to make the locking lever rotate relative to the panel-pivoting arm with the edge as a rotation center.

2. The door device of claim 1, wherein the biasing block has a cambered surface, the edge is located at a distal end of the cambered surface, and the compression spring is compressed between the bottom of the accommodating trough and the cambered surface.

3. The door device of claim 1, wherein the holder has an annular groove located in the accommodating trough, and the engaging block is slidably engaged in the annular groove.

4. The door device of claim 3, wherein an inner wall surface of the annular groove has a first concave vertex adjacent to the bottom of the accommodating trough, and an outer wall surface of the annular groove has a second concave vertex adjacent to the entrance; when the panel-pivoting arm switches to the received status relative to the holder, the engaging block is engaged at the first concave vertex, and when the panel-pivoting arm switches to the ejected status relative to the holder, the engaging block is engaged at the second concave vertex.

5. The door device of claim 4, wherein the panel-pivoting arm is slidably accommodated in the accommodating trough along a sliding direction, and the annular groove has a first path and a second path that are in spatial communication end to end between the first concave vertex and the second concave vertex; wherein during a period that the panel-pivoting arm switches from the received status to the ejected status relative to the holder, the panel-pivoting arm slides toward a bottom of the holder along the sliding direction to make the engaging block leave the first concave vertex, and the compression spring then pushes the biasing block to make the panel-pivoting arm slide toward the entrance along the sliding direction and make the locking lever rotate relative to the panel-pivoting arm, so as to make the engaging block slide to the second concave vertex from the first concave vertex along the first path.

6. The door device of claim 5, wherein the inner wall surface of the annular groove further has a convex vertex adjacent to the second concave vertex, the convex vertex deviates toward the first path in a horizontal direction perpendicular to the sliding direction, and the second concave vertex deviates toward the second path in the horizontal direction; wherein during a period that the panel-pivoting arm switches from the ejected status to the received status relative to the holder, the panel-pivoting arm slides toward the holder along the sliding direction, so as to make the engaging block leave the second concave vertex and slide to the first concave vertex along the second path.

7. The door device of claim 5, wherein the holder further has an assembling groove, the assembling groove is located in the accommodating trough and in spatial communication with the entrance and the first path, and the engaging block is engaged in the annular groove from the entrance via the assembling groove.

8. The door device of claim 1, wherein the panel-pivoting arm further has a shaft hole and comprises a cantilever, a distal end of the cantilever extends into an extending surface of an inner wall of the shaft hole, the door comprises a door-pivoting arm, the door-pivoting arm is pivotally connected to the shaft hole and has at least one indentation, and the indentation is configured to engage with the distal end of the cantilever, so as to fix a rotation angle with which the door is rotated relative to the panel-pivoting arm.

9. A storage equipment, comprising:

a housing having an assembling opening and an accommodating space inwardly formed from the assembling opening; and a door device comprising:

a panel fixed to the housing and covering the assembling opening, the panel having a doorway;

a pivoting arm module comprising a holder and a panel-pivoting arm, the holder located in the doorway and fixed to the panel, the holder having an entrance and an accommodating trough inwardly formed from the entrance, wherein the panel-pivoting arm is slidably accommodated in the accommodating trough from the entrance, and is capable of switching to a received status or an ejected status relative to the holder; and a door pivotally connected to the panel-pivoting arm, wherein when the panel-pivoting arm switches to the received status relative to the holder, the door abuts against the panel and closes the doorway, and an appearance surface of the door is flush with an appearance surface of the panel, and when the panel-pivoting arm switches to the ejected status relative to the holder, the door leaves the panel and is capable of rotating relative to the panel-pivoting arm to open the doorway, wherein the panel-pivoting arm has a first through hole, the pivoting arm module further comprises a locking lever, and the locking lever comprises:

a linkage;

a biasing block connected to an end of the linkage and engaged in the first through hole, wherein the biasing block has an edge, and the edge deviates from an axis of the linkage and abuts against an inner wall of the first through hole; and an engaging block connected to another end of the linkage and slidably engaged with an inner wall of the accommodating trough, and wherein the panel-pivoting arm further has a second through hole in spatial communication with the first through hole, the pivoting arm module further comprises a compression spring, the compression spring is accommodated in the second through hole and compressed between a bottom of the accommodating trough and the biasing block, so as to make the locking lever rotate relative to the panel-pivoting arm with the edge as a rotation center.

10. The storage equipment of claim 9, wherein the biasing block has a cambered surface, the edge is located at a distal end of the cambered surface, and the compression spring is compressed between the bottom of the accommodating trough and the cambered surface.

11. The storage equipment of claim 9, wherein the holder has an annular groove located in the accommodating trough, and the engaging block is slidably engaged in the annular groove.

12. The storage equipment of claim 11, wherein an inner wall surface of the annular groove has a first concave vertex adjacent to the bottom of the accommodating trough, and an outer wall surface of the annular groove has a second concave vertex adjacent to the entrance; when the panel-pivoting arm switches to the received status relative to the holder, the engaging block is engaged at the first concave vertex, and when the panel-pivoting arm switches to the ejected status relative to the holder, the engaging block is engaged at the second concave vertex.

13. The storage equipment of claim 12, wherein the panel-pivoting arm is slidably accommodated in the accommodating trough along a sliding direction, and the annular groove has a first path and a second path that are in spatial communication end to end between the first concave vertex and the second concave vertex; wherein during a period that the panel-pivoting arm switches from the received status to the ejected status relative to the holder, the panel-pivoting arm slides toward a bottom of the holder along the sliding direction to make the engaging block leave the first concave vertex, and the compression spring then pushes the biasing block to make the panel-pivoting arm slide toward the entrance along the sliding direction and make the locking lever rotate relative to the panel-pivoting arm, so as to make the engaging block slide to the second concave vertex from the first concave vertex along the first path.

14. The storage equipment of claim 13, wherein the inner wall surface of the annular groove further has a convex vertex adjacent to the second concave vertex, the convex vertex deviates toward the first path in a horizontal direction perpendicular to the sliding direction, and the second concave vertex deviates toward the second path in the horizontal direction; wherein during a period that the panel-pivoting arm switches from the ejected status to the received status relative to the holder, the panel-pivoting arm slides toward the holder along the sliding direction, so as to make the engaging block leave the second concave vertex and slide to the first concave vertex along the second path.

15. The storage equipment of claim 13, wherein the holder further has an assembling groove, the assembling groove is located in the accommodating trough and in spatial communication with the entrance and the first path, and the engaging block is engaged in the annular groove from the entrance via the assembling groove.

16. The storage equipment of claim 9, wherein the panel-pivoting arm further has a shaft hole and comprises a cantilever, a distal end of the cantilever extends into an extending surface of an inner wall of the shaft hole, and the door comprises a door-pivoting arm, the door-pivoting arm is pivotally connected to the shaft hole and has at least one indentation, the indentation is configured to engage with the distal end of the cantilever, so as to fix a rotation angle with which the door is rotated relative to the panel-pivoting arm.

* * * * *